United States Patent [19]

Friedman et al.

[11] 4,318,352

[45] Mar. 9, 1982

[54] ADJUSTABLE SHELVING HAVING A SPIRAL ENGAGEMENT ARRANGEMENT

[75] Inventors: Abraham Friedman, Brooklyn, N.Y.; John H. Welsch, Moscow, Pa.

[73] Assignee: Metropolitan Wire Corporation, Wilkes-Barre, Pa.

[21] Appl. No.: 147,833

[22] Filed: May 8, 1980

[51] Int. Cl.[3] ..... A47B 9/00

[52] U.S. Cl. ..... 108/111; 248/188

[58] Field of Search ..... 108/111, 156, 144; 211/187, 191; 248/407, 411, 412, 188, 188.8, 188.5, 188.1

[56] References Cited

U.S. PATENT DOCUMENTS

| | | | |
|---|---|---|---|
| 3,043,641 | 7/1962 | Hanmore | 248/188.5 |
| 3,312,440 | 4/1967 | Zelony | 248/188.8 |
| 3,344,756 | 10/1967 | Kelson | 248/188.1 X |
| 3,424,111 | 1/1969 | Maslow | 108/144 |
| 3,523,508 | 8/1970 | Maslow | 108/144 |
| 3,757,705 | 9/1973 | Maslow | 108/144 |
| 3,874,511 | 4/1975 | Maslow | 108/156 X |
| 4,138,953 | 2/1979 | Tashman | 108/144 |

*Primary Examiner*—Ramon S. Britts
*Assistant Examiner*—Peter A. Aschenbrenner
*Attorney, Agent, or Firm*—Friedman, Goodman & Teitelbaum

[57] ABSTRACT

Shelving including a flat shelf member positioned on corner posts, where the height is adjustable. Each of the corner posts has a spiral indentation around its exterior. Corner clamping assemblies are placed about each corner post. The clamping assemblies have frusto-conical shaped exteriors and are provided on their interior with an inwardly extending protrusion which can engage within the spiral indentation. The shelf has corner retaining members with complementary frusto-conical interiors which receive and securely hold the clamping assemblies about their respective corner posts. The spiral indentation in the corner posts permit the corner clamping assemblies to be positioned at any location along the corner posts to thereby selectively vertically position the flat shelf at a desired height. In a modified embodiment, each corner post is provided with two equally spaced spiral indentations around its exterior, so that each corner clamping assembly may include two separate identical members each provided with at least one protrusion on its interior wall. Preferably, a locating mark is disposed vertically on each corner post across the spiral indentation for positioning the corner clamping assemblies in alignment with each other.

16 Claims, 10 Drawing Figures

ADJUSTABLE SHELVING HAVING A SPIRAL ENGAGEMENT ARRANGEMENT

BACKGROUND OF THE INVENTION

This invention relates generally to shelving and more particularly to adjustable shelving of the "knock-down" type.

Adjustable metal shelving is well known. Such metal shelving has means provided to vertically adjust the shelving at a specified height. Many of these types have corner posts which support the flat shelving, and by means of set screws, set bolts, or the like, such as shown in U.S. Pat. No. 3,675,598, the flat shelving is positioned at the desired vertical height on the corner posts. However, it has been found that the use of such type of set screws, and the like, requires continuous loosening and tightening and therefore requires special tools, and is also subject to continuous wear, dents, loosening of the threaded parts and stripping of the threads.

An improvement on this type of adjustable metal shelving has been described in U.S. Pat. No. 3,424,111. In this patent, there is described an adjustable shelving including a flat shelf member which has corner supports secured to the flat shelf member at each of its corners. The corner supports are adapted to receive and securely hold the corner posts. The corner posts, in turn, are fitted with post supports which hold the corner supports and corner posts in a wedging secured arrangement. Additionally, the corner posts are provided with circular slots around its periphery graduated at fixed distances along the vertical dimension of the posts, and the post supports are provided with internal rib means or a ring-like band. Accordingly, the post supports are positioned with the rib means or ring-like band in a particular circular slot at a desired vertical height along the corner posts and are held clamped by means of the corner supports on the flat shelf member.

A further modification of this type of shelving is described in U.S. Pat. No. 3,523,508 which describes the details of the clamping arrangement utilizing frustro-conical sections between the corner supports and the post supports. The post supports also include an inwardly extending rib which engages within the circular indentations formed about the periphery of the corner posts at vertically spaced apart graduated locations.

A further variation of this type of shelving is also described in U.S. Pat. No. 3,604,369 which further utilizes a keyway formed in the corner supports and a corresponding wedge-like key formed as part of the post supports for engaging the keyway in the corner supports. The corner posts are also formed with the vertically spaced apart indents located at predetermined increments along the vertical dimension of the posts.

Although each of the aforementioned patents provide an improvement in adjustable shelving of the so called "knock-down" type, they all are limited in that the vertical position of the shelf along the posts is restricted to the particular location of the indentation formed in the corner posts. For example, if the graduated indentations are approximately 1 inch apart, the vertical positioning of the adjustable shelving is limited to such 1 inch increments. Although for many applications such graduated increments may be sufficient, it is frequently desired to have the shelving positioned at a vertical height which is between the graduated indentations.

It is accordingly a desirable feature to permit a secure continuous adjustable setting of the shelving along the corner posts so as to permit vertical positioning of the flat shelf at any desired height without limitation to specific graduated increments.

SUMMARY OF THE INVENTION

It is accordingly an object of the present invention to provide adjustable shelving which avoids the aforementioned problems of prior art shelving.

Yet another object of the present invention is to provide adjustable shelving which permits a secure continuous adjustment of the shelf along vertical corner posts.

Still another object of the present invention is to provide adjustable shelving which can be inexpensively constructed of readily available parts necessitating only a minimal number of members to the completed assembly.

Still a further object of the present invention is to provide adjustable shelving without requiring set screws or set bolts, or the use of tools in conjunction therewith, wherein the shelving includes a spiral engagement arrangement.

Yet a further object of the present invention is to provide adjustable shelving wherein the shelves are firmly held to the supporting posts and as the weight of material on the shelves increases, the shelves become increasingly more firmly engaged and tightly held onto the posts.

Briefly, in accordance with the present invention, there is provided adjustable shelving which includes corner posts each of which has a spiral indentation around its exterior. Corner clamping assemblies are provided which surround respective corner posts. The corner clamping assemblies have a frustro-conical shaped exterior and are provided on their interior with an inwardly extending protrusion engageable within the spiral indentations. A flat shelf having corner retaining members are provided. The corner retaining members have a complementary frustro-conical interior for receiving and securely holding the clamping assemblies about their respective posts.

The corner clamping assemblies can be formed of one or two parts, and can include either a spiral rib complementary to the spiral indentation of the post, or a single protrusion which will engage the spiral indentation.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

In the various figures of the drawing, like reference characters designate like parts.

DETAILED DESCRIPTION OF THE PREFERRED EMBODIMENT

Figure 1:
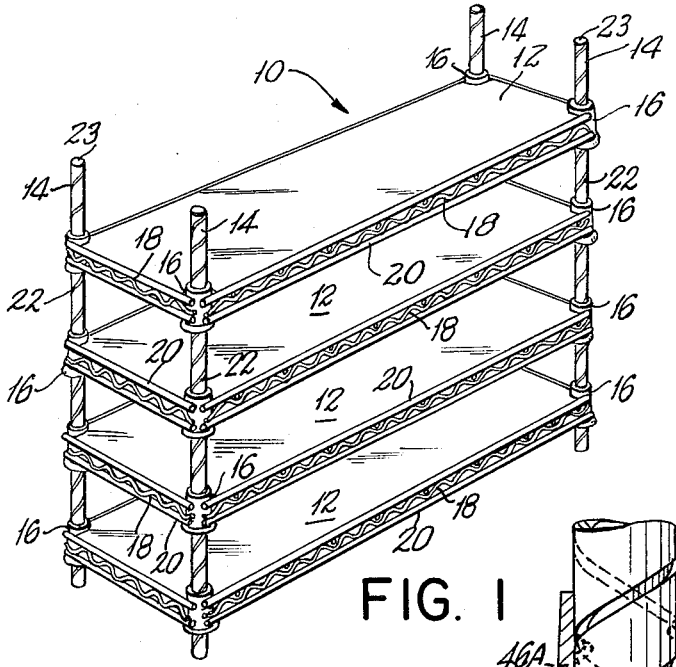
FIG. 1 is a perspective view of the adjustable shelving in accordance with the present invention.

Referring now to FIG. 1, the adjustable shelving of the present invention is shown generally at 10 and comprises a plurality of flat shelves 12 which are retained on corner posts 14 by means of corner retaining members 16. The flat shelf is shown as being constructed of the type including crisscrossing wire 18 supported along the periphery by means of parallel running rods 20 spaced beneath the upper flat shelf. However, it is understood that other types of flat shelving could similarly be utilized.

Figure 3A:
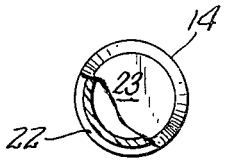
FIGS. 3A and 3B are respectively the top and front views of a corner post.
Figure 3C:
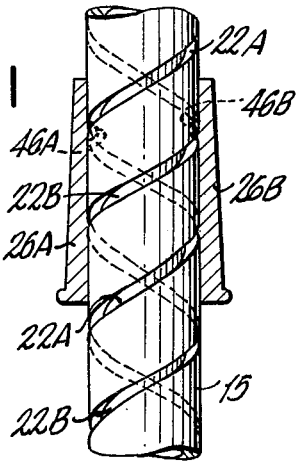
FIG. 3C is a front view of a modified corner post having two separate spiral indentations around its exterior.
Figure 3B:
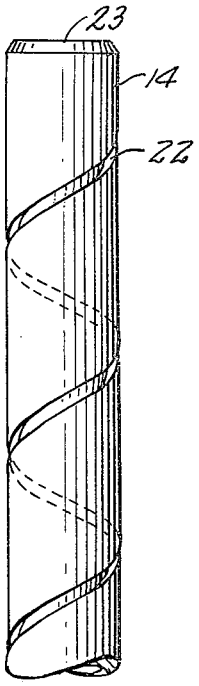

The particular corner posts which are utilized are shown in more detail in FIGS. 3A and 3B. It is noted that the corner post 14 is a tubular member having formed about its exterior a spiral indentation 22. The corner posts themselves are circular rod like members formed of a suitable material of construction such as aluminum or steel. The spiral indentation 22 can begin either at the top of the post or can be slightly spaced from the top, as shown. It is noted that a cap member 23, well known in the art, is inserted into the open top portion of the post. Although the posts are shown as being of circular tubular material, it is understood that they could be made solid, square or other suitable configuration.

Figure 2:
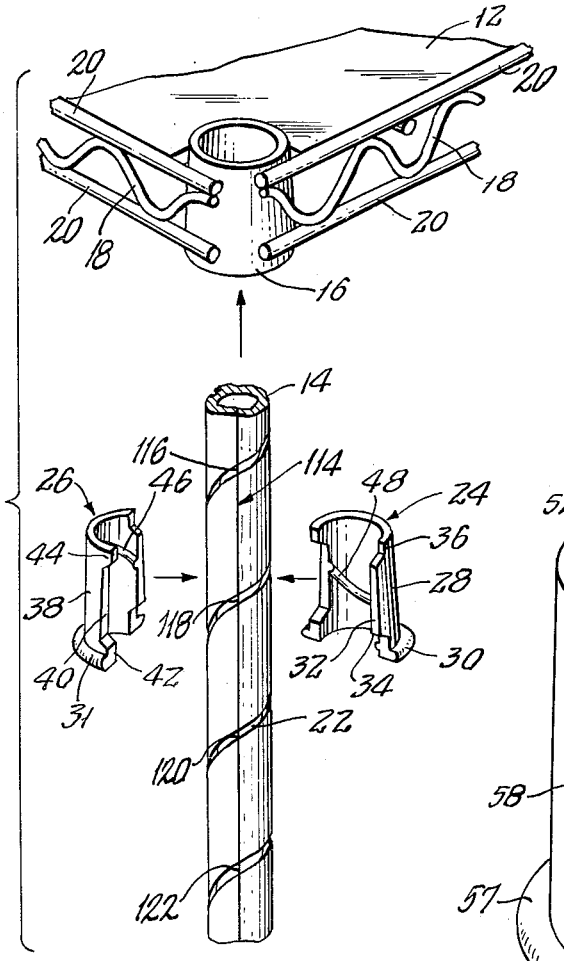
FIG. 2 is an exploded view of a corner portion of the adjustable shelving shown in FIG. 1.

Referring now to FIG. 2, the particular clamping arrangement will be described in more detail. The corner clamping assembly is shown to comprise two separate sections 24, 26. Each section includes a substantially semi-circular outer wall 28, 38 provided at its lowermost edge with a semi-circular outwardly extending flange 30, 31. One of the abutting edges of the semi-circular wall 28 is provided with a tongue and groove arrangement including the tongue portion 32 and the groove portions 34, 36, which matingly engage with the corresponding groove and tongue arrangement on the abutting edge of the wall 38, which includes the groove 40 and the corresponding tongue portions 42, 44. It will be appreciated that the other abutting edges of the walls 28, 38 have an opposite mating arrangement as shown in FIG. 2. In this manner, the two sections interfit with each other when mounted on the post 14. It is noted, that as described above, both sections 24, 26 are identical, whereas the differences therebetween is set forth below.

Each of the sections 24, 26, has a protruding rib 46, 48 on the interior surface thereof. The two ribs are formed so that when the two sections interfit, a continuous spiral rib is formed which is complementary to the spiral indentation 22 formed on the corner post. In this manner, when the two sections 24, 26 are mounted on the corner post 14, the spiral rib will engage within the spiral indentation on the corner post and the corner clamping assembly can be circularly rotated about the corner post. As a result, the clamping assembly can be positioned at any vertical height along the corner post 14 by spirally rotating the clamping assembly about the corner post. It will therefore be appreciated that the vertical height of the clamping assembly on the corner posts is not limited to specific graduated locations, but can be continuously adjusted to any desired vertical height along the corner posts.

FIG. 3C shows a modified corner post 15 having two separate spiral indentations 22A, 22B about its exterior. The spiral indentations 22A, 22B are oriented in the same direction, being 180° out of phase with each other so that each spiral indentation is equally spaced between the other spiral indentation as shown. This two spiral indentation arrangement permits the two sections of the corner assembly to each have a protrusion on its interior wall in such a manner that the two sections are identical. For example, the section 26 shown in FIG. 2 can be combined with an identical section to form a clamping assembly having the two sections identified as 26A, 26B. Thus, as shown in FIG. 3C, the spiral rib 46A of section 26A is engaged in the spiral indentation 22A with the spiral rib 46B of section 26B being engaged in the spiral indentation 22B. As indicated above, the two sections 26A, 26B will interfit with each other when mounted on the post 15.

It is noted, that the two spiral indentations of the post 15 will function equally as well with a pair of the sections 24 shown in FIG. 2, a pair of either of the sections 50, 52 shown in FIG. 4, as will be described below, and a pair of either of the sections 100, 104 shown in FIG. 8, which will also be discussed hereinafter below. It is further noted, that the use of the double spiral post 15 would reduce production costs of the sections of the clamping assembly wherein a mold or stamping of only one section is required. Furthermore, it would only be required to stock a plurality of the one section, wherein there would be no confusion in matching the sections as would be if two different sections were used in the clamping assembly.

Once the clamping assemblies have been mounted on the corner posts with the spiral ribs engaging within the spiral indentations of the posts, each corner retaining member 16 is placed over the respective two sections of each clamping assembly to hold them in tight engagement with the corner post and to retain them in place.

It will be noted that the outer peripheral shape of the two sections 24, 26, which form the corner assembly, is such as to be frustro-conical. The interior shape of the corner retaining member 16 is also frustro-conical and complementary to the exterior of the two sections forming the corner assembly. In this manner, as the corner retaining member 16 is placed over the two sections of the corner assembly, it wedgingly holds them securely together and locks them tightly about the corner post. As additional weight is placed on the shelf, the corner retaining member will further wedgingly clamp the two sections together and thereby further tighten them against the corner post. In this manner, additional weight only tends to further wedge the members together to hold the shelf more securely in place.

Although the lower edge of the corner retaining member 16 is not intended to reach the bottom of the corner assembly, after continued use, and as the members tend to wear, the corner retaining member may reach the lower edge. For this purpose, the flanges 30, 31 are provided on the sections 24, 26 to abut against and stop the corner retaining member 16 to ensure the maximum extension of the corner retaining member 16 over the clamping assembly.

Figure 4:
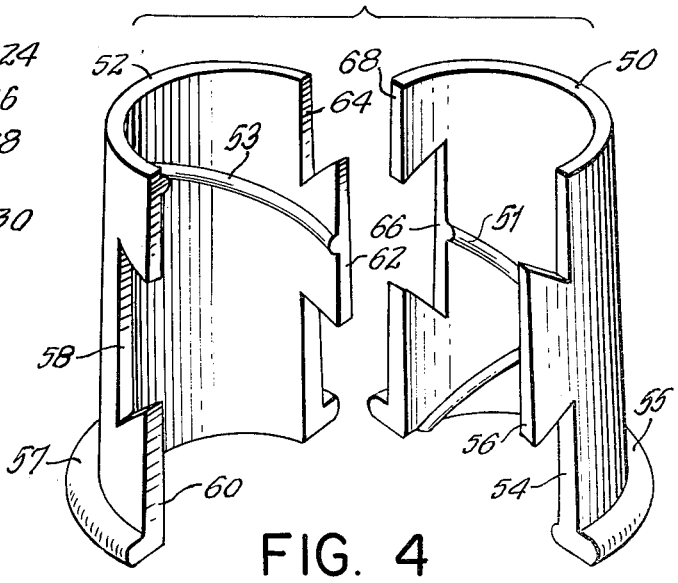
FIG. 4 is an exploded view of a corner clamping assembly in accordance with one embodiment of the present invention.

Referring now to FIG. 4, there is shown in more detail a modified embodiment of the sections of the clamping assembly. Again, there are provided two sections 50 and 52 which interfit with each other and clamp about the corner post. Each of the sections have abutting faces which are arranged with a dovetail interfitting connection. Specifically, on the section 50, one abutting edge 54 has a protruding dovetail section 56 which interfits with the receiving complementary dovetail recess 58 formed on the corresponding abutting edge 60 of section 52. At the same time, an opposite type of arrangement is formed at the other abutting edges with the dovetail section 62 protruding from the abutting edge 64 of section 52 which is received in the complementary recess 66 formed on the abutting edge 68 of section 50. In the same manner as the above mentioned sections 24, 26 of FIG. 2, each of the sections 50, 52 has a protruding spiral-like rib 51, 53 on the interior surface thereof for the same function described above. Furthermore, the flanges 55, 57 on the sections 50, 52 function the same as the above mentioned flanges 30, 31 on the previously described sections 24, 26.

By increasing the effective circular peripheral length of each clamping section 24, 26 and 50, 52 slightly more than half of the circumference of the post 14, it is possible to have each of the sections snap fit on the corner post so that each section will actually be held by itself. Accordingly, the extension of the tongue portion 32 and the dovetail section 56, 62, each formed at one abutting edge, provides the additional circular peripheral length in the form of a lip to facilitate the snapping of the section about the corner post and retain each section in place by itself. In this manner, one section can be mounted on the corner post and positioned at the desired height. That section will remain in place and the mating other section can then also be mounted and snapped into place. The abutting edges with the appropriate tongue and groove or dovetail arrangement will then be interfitted into each other.

Figure 5:
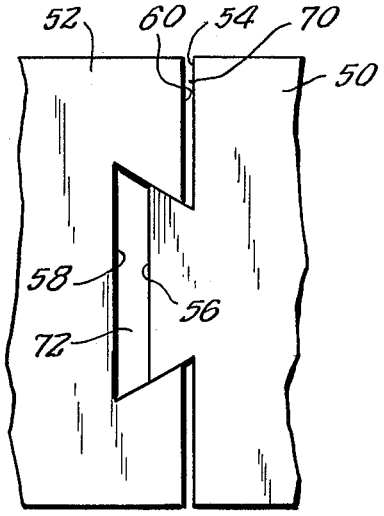
FIG. 5 is a detailed view of an interconnecting arrangement for sections of the clamping assembly shown in FIG. 4.

By making each of the body sections, excluding the tongue portion and the dovetail section, slightly less than half of the circumference of the corner post, an additional benefit is provided as shown in FIG. 5. Specifically, there is shown parts of each of the sections 50 and 52, and the dovetail interfitting arrangement including the protruding portion 56 and the groove 58. It will be noted that a slight space 70 is formed between the abutting edges 54, and 60. This slight space between the abutting edges permits the two sections to be wedged towards each other when the corner retaining member, which is connected to the shelf, is placed over these two sections to clamp them together. Thus, this will further clamp the sections about the corner posts and hold them together.

It should further be noted in FIG. 5, that the dovetail protrusion 56 is also spaced from the back edge of the recess 58 which receives the dovetail, in order to form the space 72. This space 72 is slightly larger than the space 70 so that even after the two sections are fully clamped together, there will still exist this space 72. The purpose of this space 72 is to facilitate separating the two sections of the clamping member. A tool, such as a screwdriver, can be inserted into the space 72 and can be used as a wedge to separate the two sections so that they can each be easily removed from the corner post.

Figure 6:
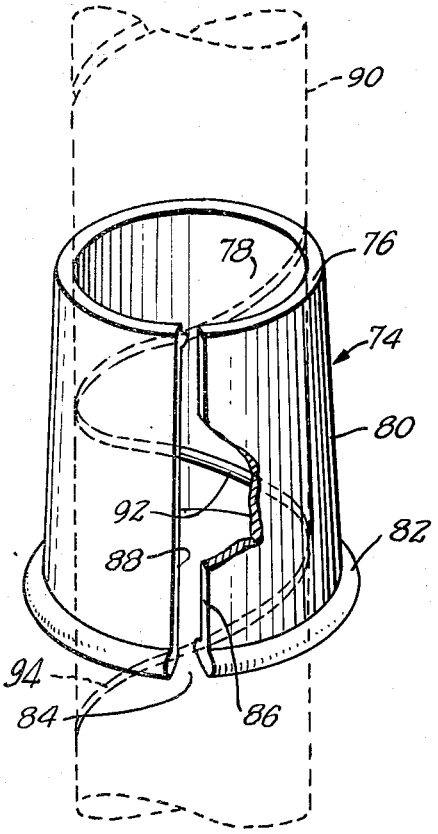
FIG. 6 is a perspective view of another embodiment of a clamping assembly in accordance with the present invention.

Although the clamping assembly has thus far been described as being formed of two sections interfitting with each other, it should be understood that the clamping assembly could also be formed of a single section, as shown in FIG. 6. More specifically, the clamping assembly is shown as a circumferential member 74 having a wall 76 forming a cylindrical interior 78 and a frustroconical shaped exterior 80. An outwardly protruding flange 82 is formed at the lower peripheral edge of the wall 76. A slot 84 is formed longitudinally through the entire member so as to form a space defined between the facing walls 86, 88 of the slot. The interior circumference 78 of the member 74 is preferably slightly less than the outer circumference of the corner post 90, shown in phantom, to provide a tight fit therebetween. On the interior of the cylindrical surface 78 is formed a spiral rib, a portion of which is shown at 92.

The clamping assembly 74 shown in FIG. 6 can be spread apart and slid down on the post to the desired vertical height. The two facing walls 86, 88 can then be released to clamp the assembly on the post. The protruding spiral rib 92 on the interior surface of the clamping assembly will then be engaged into the spiral indentation 94 formed about the periphery of the corner post 90. It is noted, that when the spiral rib 92 is engaged in the spiral indentation 94, the clamping assembly 74 can also be rotated on the post to the desired vertical height. The corner retaining member on the shelf can then be placed over the clamping member 74 and as it is pushed down it will force the two faces 86, 88 closer to each other, thereby clamping the clamping assembly onto the corner post.

Figure 7:
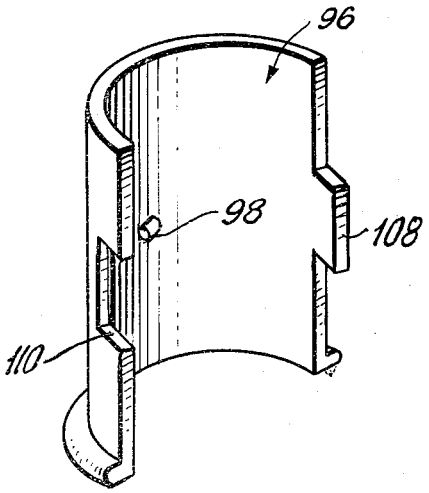
FIG. 7 shows a portion of a modified clamping assembly having another type of a projecting rib.

Heretofore, there was described the formation of an interior rib which protrudes from the clamping assembly and was described as being a spiral in order to engage the spiral indentation. However, the protrusion need not be a spiral about the interior wall of the clamping assembly. As shown in FIG. 7, there is provided one section of a clamping assembly 96 which has only a single segment 98 protruding from an internal wall. The segment 98 can be a dimple, a bar or any other section which protrudes and which can engage into the spiral indentation in the corner post. If it is a simple dimple, as shown, it can be positioned anywhere on the interior and it will engage within the spiral indentation. If the protrusion is elongated in shape, it should be placed at an angle commensurate with the angular pitch of the spiral indentation in the corner post.

The corresponding section that would mate with the section shown in FIG. 7 could be formed without any protrusion at all. Since each section is formed so that it will snap around the corner post, the section shown in FIG. 7 will snap onto the corner post and the protrusion 98 will ride within the spiral indentation formed about the corner post. The other mating section need not have any indentation and will still snap around and engage within the section shown in FIG. 7. On the other hand, both sections could have indentations.

Figure 8:
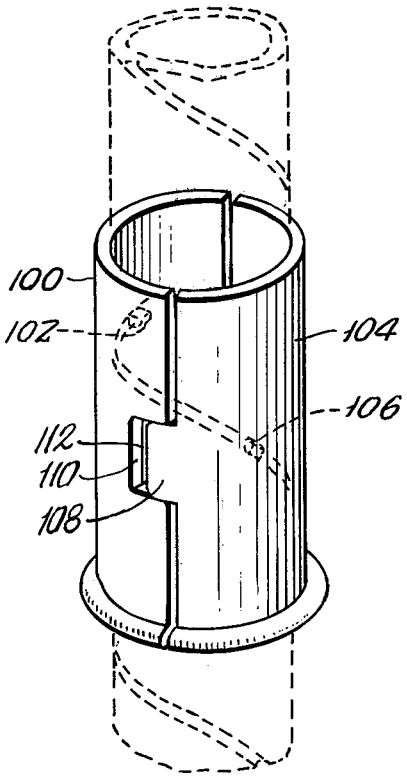
FIG. 8 is a perspective view of another embodiment of a clamping assembly.

As shown in FIG. 8, if both sections have indentations, then the indentations must be formed so that they will both properly fit within the spiral groove at the same time when fitted together. Thus, by way of example, in the section shown at 100 in FIG. 8, there is provided a protrusion 102 while in the mating section 104 there is provided a corresponding protrusion 106. The protrusions 102 and 106 are vertically spaced apart so that they will respectively ride within appropriate locations in the spiral indentation. At the same time, it will be noted that since these protrusions 102, 106 are elongated, they are placed at an angle having a pitch corresponding to the pitch of the spiral.

It is further noted, that the spiral indentation in the post shown in FIG. 8 has an opposite direction than the previously shown spiral indentations of FIGS. 1, 2, 3B and 6, wherein except for the clamping assembly 96 of FIG. 7, the spiral ribs or protrusions must match the direction of the spiral indentation, where both directions function in the same manner set forth above if properly matched.

The particular parts forming the corner assembly can be formed of either plastic or metal. When formed of plastic, since there is provided more of a flexure than with metal, the dovetail engagement shown in FIGS. 4 and 6 may be preferable when forming the clamping assembly. However, if there is sufficient flexing of the metal material, such dovetail could also be utilized with metal parts. However, where the metal is rather stiff, a preferable arrangement might be the tongue and groove arrangement shown in FIG. 2 or shown in FIGS. 7 and 8. The clamping assembly 96 of FIG. 7 and sections 100, 104 of FIG. 8 are provided with a tongue 108 which is received in a groove 110, whereby a space 112 is provided therebetween to facilitate separation thereof in the same manner as the space 72 mentioned above and shown in FIG. 5.

Preferably, a locating mark or scale 114 is printed or otherwise placed vertically upon the outer surface of each corner post across the spiral indentation at points 116, 118, 120, 122, as shown in FIG. 2, for positioning the corner clamping assemblies in alignment with each other. For example, by positioning a top edge of each of the corner clamping assemblies at any desired one of the points 116–122 etc., and when using a two section clamping assembly, placing the facing side edges of the two sections of each clamping assembly along the locating mark 114, all of the clamping assemblies can be positioned at the same height to easily construct the shelving 10 shown in FIG. 1, without the use of any other measurement or scale instrument.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. Adjustable shelving comprising:

corner posts each having a spiral indentation around an exterior wall thereof;

corner clamping assemblies each for surrounding a respective corner post, each clamping assembly having a frustro-conically shaped exterior wall with a protrusion provided on its interior wall, said protrusion being engageable within said spiral indentation; and a shelf provided with corner retaining members, each retaining member having a complementary frustro-conical interior wall for receiving and securely holding a respective clamping assembly about its respective post.

2. Adjustable shelving according to claim 1, wherein said protrusion includes a spiral rib complementary to said spiral indentation for engagement therein.

3. Adjustable shelving according to claim 1, wherein each corner clamping assembly includes at least two separate members adapted to inter-engage one another in a holding position when said protrusion is positioned in said spiral indentation, said clamping assembly members snugly fitting within a respective corner retaining member.

4. Adjustable shelving according to claim 3, wherein an effective interior diameter of each of said two members of said clamping assembly is slightly more than an exterior diameter of the post, and said two members are resilient, whereby each member snap fits around the post and whereby said corner retaining member is able to press the two members into a close engagement to effect a secure holding onto the post.

5. Adjustable shelving according to claim 4, wherein said two members are provided with a dovetail arrangement along their abutting edges for interconnecting said two members together.

6. Adjustable shelving according to claim 3, wherein said two members are provided with a tongue and groove arrangement along their abutting edges for interconnecting the two members together.

7. Adjustable shelving according to claim 3, wherein interconnecting means are provided between said two members for inter-engaging one another, said interconnecting means providing a space therebetween for separating said two members by inserting a tool into said space and wedging them apart.

8. Adjustable shelving as in claim 3, wherein each of said two members includes a single projection defining said protrusion, said projections being in spaced arrangement corresponding to the spiral indentation for engagement therein.

9. Adjustable shelving as in claim 3, wherein only one of said two members includes a single projection defining said protrusion for engagement in the spiral indentation.

10. Adjustable shelving as in claim 1, wherein each corner assembly includes a circular walled member having a cylindrical interior wall opposing the frustro-conically shaped exterior wall, and a longitudinal slot provided through said walled member from one end to an opposite end.

11. Adjustable shelving as in claim 1, wherein said protrusion includes a single projection.

12. Adjustable shelving as in claim 1, and further comprising exteriorly disposed flange means laterally extending from a lower part of said clamping assembly for providing a lower abutment to stop the sliding of the retaining member thereover.

13. Adjustable shelving according to claim 1, wherein said corner posts each have a second spiral indentation around its exterior wall.

14. Adjustable shelving according to claim 13, wherein said second spiral indentation is oriented in the same direction as said first-mentioned spiral indentation and is equally spaced between said first-mentioned spiral indentation.

15. Adjustable shelving according to claim 14, wherein each corner clamping assembly includes two separate members each provided with at least one said protrusion on its interior wall, said two separate members being identical.

16. Adjustable shelving according to claim 1, wherein each corner post is provided with locating means disposed vertically thereon across said spiral indentation for positioning said corner clamping assemblies in alignment with each other.

* * * * *